United States Patent [19]

Jenkins

[11] 4,163,625

[45] Aug. 7, 1979

[54] MOVABLE WORKING PLATFORM FOR USE IN RACKING DRILL PIPE

[75] Inventor: Cecil Jenkins, Tulsa, Okla.

[73] Assignee: Lee C. Moore Corporation, Tulsa, Okla.

[21] Appl. No.: 876,668

[22] Filed: Feb. 10, 1978

[51] Int. Cl.[2] ..... E21B 19/14

[52] U.S. Cl. ..... 414/22; 175/85; 182/114; 414/508

[58] Field of Search ..... 214/2.5, 1 P, 83.1; 175/85; 182/114

[56] References Cited

U.S. PATENT DOCUMENTS

| | | | |
|---|---|---|---|
| 2,389,045 | 11/1945 | Haddock | 182/114 X |
| 3,976,207 | 8/1976 | Schultz | 175/85 X |

*Primary Examiner*—Albert J. Makay
*Assistant Examiner*—George F. Abraham
*Attorney, Agent, or Firm*—Brown, Flick & Peckham

[57] ABSTRACT

Suspension members flexibly connected to a carriage and to an overhead support above the racking platform of an oil well mast or derrick support the carriage, which is provided with a floor to support a derrick man therein. The lower end of the suspension means can be swung back and forth parallel to the side of the mast or derrick and also at right angles to it to thereby move the carriage in the same directions, the carriage being provided with a lateral seat for receiving the upper end portion of a pipe and moving it with the carriage into another position.

6 Claims, 6 Drawing Figures

MOVABLE WORKING PLATFORM FOR USE IN RACKING DRILL PIPE

In drilling deep wells the derrick man works high above the floor of the derrick or mast, where he connects and disconnects the elevators from the stands of drill pipe and manipulates the stands into and out of their setback position in a pipe rack. In doing this the derrick man must traverse a considerable area, for example, an area of about 9 feet by 14 feet, often on insecure footing while manipulating heavy stands of drill pipe.

It is among the objects of this invention to provide a safe and secure place for the derrick man to work while pipe is going into or coming out of the hole, and also to reduce the physical effort required of him to manipulate the stands of drill pipe into and out of a pipe rack.

The preferred embodiment of the invention is illustrated in the accompanying drawings, in which FIG. 1 is a front view of a racking platform and the pipe racking apparatus above it;

Figure 1:
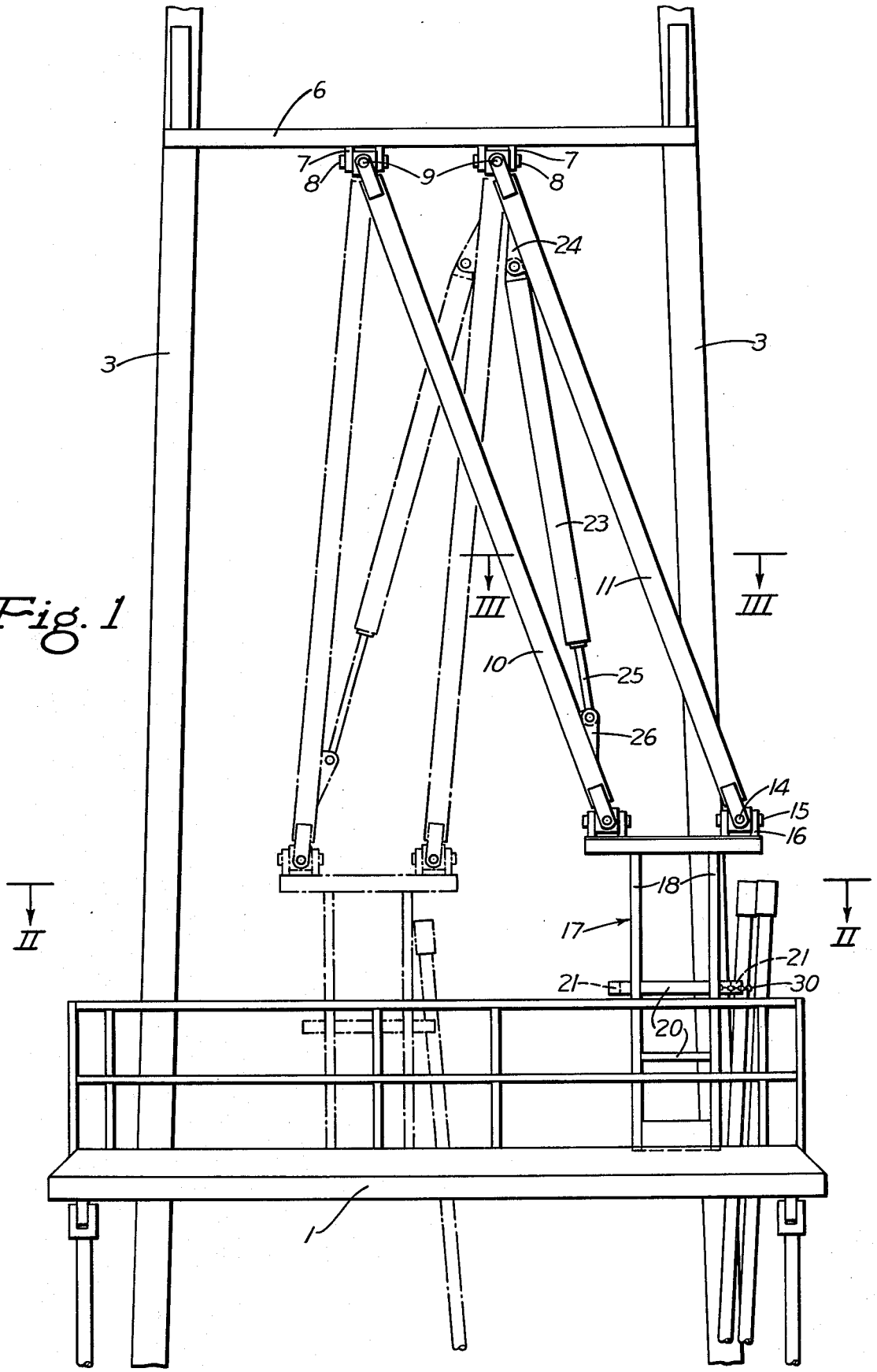
Figure 3:
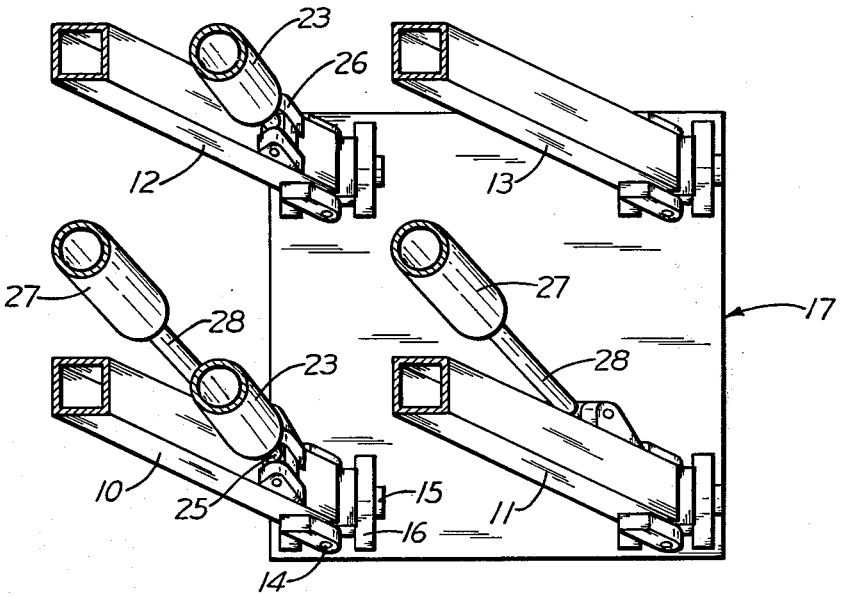
FIG. 3 is an enlarged horizontal section taken on the line III—III of FIG. 1.

Referring to FIG. 1 of the drawings, a pipe racking platform extends forward from the front of an oil well drilling mast. In the case of a derrick, the platform would extend inwardly from one side. The main frame 1 of the platform is secured at its ends to bars 2 welded to the front legs 3 of the mast structure. The frame supports two rows of laterally spaced racking fingers 4. These extend toward each other from the opposite ends of the platform, but they are spaced apart to permit drill pipe to be moved between them and then between the fingers in either row. Some distance above the racking platform there is a framework 6 forming an overhead support projecting from the front of the mast. Secured to the bottom of this support midway between its ends are four brackets 7 arranged in a rectangle. Pivot pins 8 are mounted in these brackets parallel to the adjacent side of the mast. Other pivot pins 9 extend transversely through pins 8 and support the upper ends of four parallel links or arms 10, 11, 12 and 13 (FIG. 3). The lower ends of these arms are pivotally mounted in the same way by pivot pins 14 and 15 in brackets 16 secured to the top of a carriage 17.

Extending downwardly from the carriage top are four corner columns 18, the lower ends of which support a floor 19 (FIG. 2) so that the derrick man can stand in the carriage. The carriage floor is a short distance above the level of the racking fingers and serves as the working platform for a derrick man. The corner columns of the carriage are connected by cross bars 20 that serve as guard rails. Projecting from the two opposite sides of the carriage that are in planes perpendicular to the front of the mast are pipe-receiving seats 21.

Figure 4:
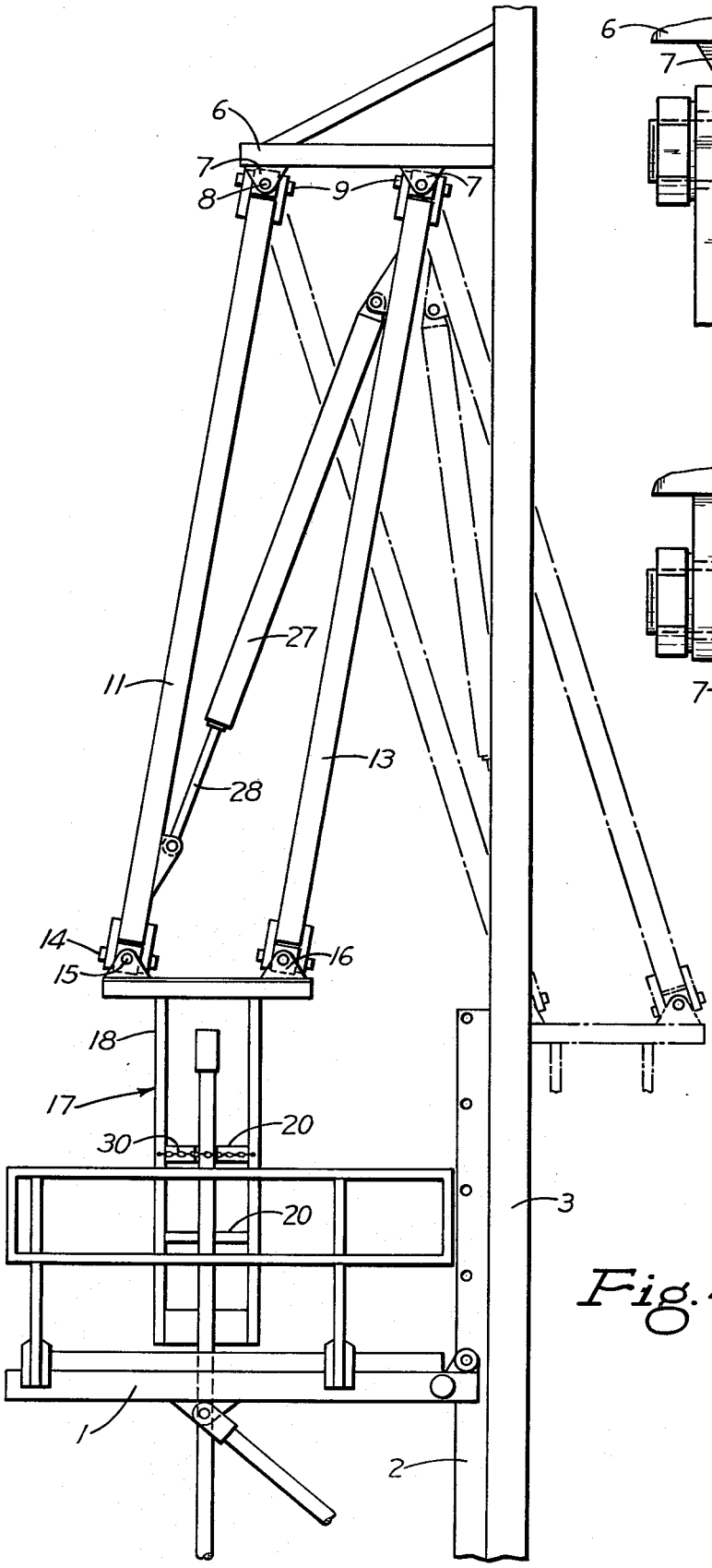
FIG. 4 is an end view of the platform showing only one of the pipe stands.
Figure 5:
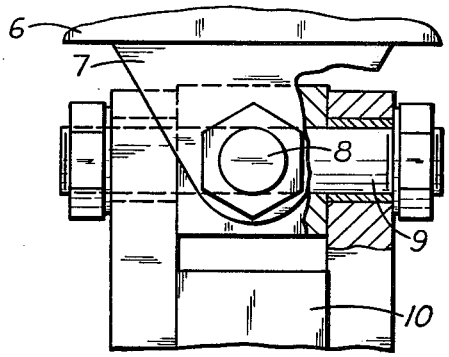
FIG. 5 is an enlarged side view, partly broken away, of one of the supporting bearings for the upper end of a pivoting arm.
Figure 6:
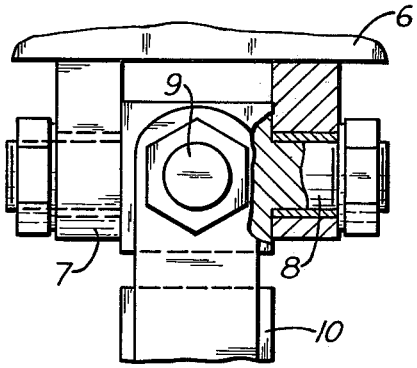
FIG. 6 is a view of the bearing turned 90° from FIG. 5.

In order to move the carriage to any desired location over the racking platform and also to move it into the mast to one side or the other of a stand of drill pipe suspended from the travelling block, means are provided for swinging the lower ends of the four arms and hence the carriage 17, in a plane parallel to the front of the mast and also in a plane perpendicular to it. Preferably, this is accomplished by fluid pressure means, such as hydraulic cylinders connected by hoses to apparatus for producing hydraulic pressure. Such apparatus, not shown, may be mounted on framework 6 or in some other suitable location. Although one cylinder could be used for each direction of movement, it is preferred to use two. Thus, the upper ends of a pair of parallel cylinders 23 are pivotally connected to brackets 24 mounted on two of the arms 11 and 13 near one end, preferably their upper ends. The cylinders extend downwardly and toward the other two arms, and the piston rods 25 projecting from the lower ends of the cylinders are pivotally connected to brackets 26 mounted on those other two arms near their lower ends. Each of the other two parallel cylinders 27 and their piston rods 28 shown in FIGS. 3 and 4 are connected in the same way between two arms disposed in a plane at right angles to the planes in which lie a pair of arms connected to either of the cylinders 23. That is, one cylinder 27 is connected to arms 10 and 12, and the other cylinder 27 is connected to arms 11 and 13. Operation of the other pair of cylinders will move the arms and carriage into and out of the mast as indicated in FIG. 4. Control of the fluid pressure is by conventional manually operated valves.

OPERATION

Figure 2:
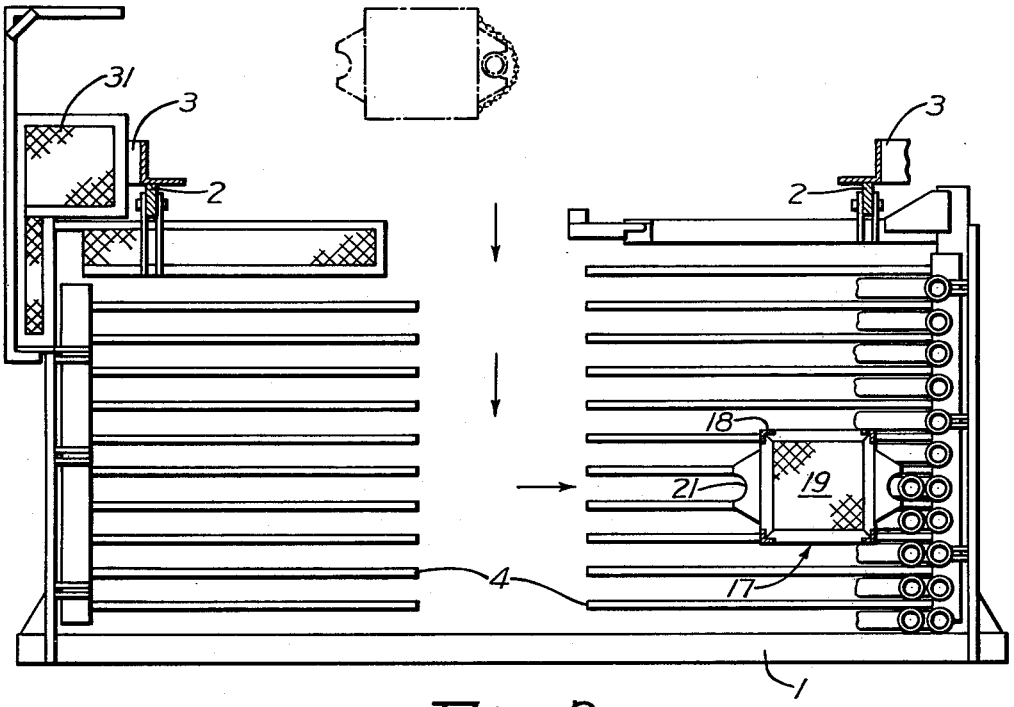
FIG. 2 is a plan view.

In racking a stand of pipe pulled from a well and suspended from the elevators carried by the traveling block, the freed lower end of the pipestand is moved over to the pipe setback beneath the racking platform and then is lowered onto it. While that is occuring, the derrick man in carriage 17 operates the controls with which the carriage is provided to deliver fluid pressure to the lower ends of cylinders 27 and exhaust fluid from their upper ends. This causes the pistons to rise in the cylinders and to swing the lower ends of the four arms and the carriage into the mast as shown in dotted lines in FIG. 4. At the same time, the derrick man supplies fluid pressure to the upper ends of cylinders 23 and exhausts fluid from their lower ends so that the carriage will be swung to one side of the centerline of the well. As illustrated in FIGS. 1 and 2, the carriage may be moved to a position between the left-hand side of the leaning pipestand and the side of the mast and then it is moved to the right to the dotted line position, in which right-hand seat 21 receives the pipe. The derrick man then fastens a chain 30 around the pipe to make sure it will not move out of its seat, he releases the stand from the elevators and then he reverses the fluid pressure in cylinders 27 to move the carriage out of the mast into a location above the racking platform, with the upper end of the pipestand being moved by the carriage outwardly between the two rows of racking fingers.

When the upper portion of the pipe is opposite the space between the pair of fingers, between which the pipe is to be racked, outward travel of the carriage is stopped and the fluid pressure in cylinders 23 is reversed to cause the arms to swing the carriage to the right to the full line position in FIGS. 1, 2 and 3 so that it will rack the pipestand between a pair of fingers. As soon as the pipe is released from the carriage, the latter is moved back into the mast to receive the next pipestand.

The path of movement of the carriage is under control of the derrick man at all times, since he can control admission of fluid pressure to the four cylinders and that determines the movements of the carriage. It will be seen that racking the pipe in this way requires little effort on the part of the derrick man and that he is safely enclosed in the carriage while he works. When he is finished with his work he can cause the carriage to move over to the ladder platform 31 (FIG. 2) at one inner corner of the racking platform where he can step out of the carriage onto the latter platform and then descend the usual ladder to the foot of the mast.

According to the provisions of the patent statutes, I have explained the principle of my invention and have illustrated and described what I now consider to represent its best embodiment. However, I desire to have it understood that, within the scope of the appended claims, the invention may be practiced otherewise than as specifically illustrated and described.

I claim:

1. Apparatus for racking pipe stands in the racking platform of an oil well drilling mast or derrick structure, comprising a support adapted to project from the side of such a structure above its racking platform, suspension means extending downwardly from said support and suspended therefrom, a carriage suspended from the lower end of said suspension means and provided with a floor to support a derrick man inside the carriage, the suspension means being flexibly connected to said support and carriage, means for selectively swinging the lower end of said suspension means back and forth in a first vertical plane and back and forth in a second vertical plane at right angles to said first plane to thereby move the carriage in the same directions, and pipe-receiving means projecting from the side of the carriage for engaging the side of the upper portion of a pipe and moving it with the carriage to another location.

2. Apparatus according to claim 1, in which said pipe-receiving means project from two opposite sides of the carriage.

3. Apparatus according to claim 1, in which said swinging means include fluid pressure cylinders carried by said suspension means.

4. Apparatus according to claim 1, in which said suspension means include a parallel linkage system, and pivotal means connecting said linkage system to said support and carriage on axes parallel to both of said planes.

5. Apparatus according to claim 4, in which said linkage system includes four parallel arms arranged in a rectangle, and a pair of pivot pins at each end of each arm, the pins in each pair being disposed at right angles to each other and serving as said pivotal means.

6. Apparatus according to claim 5, in which said swinging means include a fluid pressure cylinder with projecting piston rod, means pivotally connecting the outer end of the cylinder to one of said arms near one end thereof, means pivotally connecting the outer end of said rod to an adjacent arm near the opposite end thereof, a second fluid pressure cylinder with projecting piston rod, means pivotally connecting the outer end of the second cylinder to one of the arms near one end thereof, and means pivotally connecting the outer end of the second piston rod with an adjacent arm near the opposite end thereof, one of the two last-mentioned arms being other than either of the two first-mentioned arms, and each of said cylinders being formed to admit fluid under pressure to either end.

* * * * *